US005236129A

United States Patent [19]

Grime et al.

[11] Patent Number: 5,236,129

[45] Date of Patent: Aug. 17, 1993

[54] ERGONOMIC HAND HELD PAINT SPRAY GUN

[75] Inventors: Thomas E. Grime, Temperance, Mich.; James P. Baltz, Waterville; Roger T. Cedoz, Curtice, both of Ohio

[73] Assignee: Ransburg Corporation, Indianapolis, Ind.

[21] Appl. No.: 894,730

[22] Filed: May 27, 1992

[51] Int. Cl.[5] ..... B05B 7/02

[52] U.S. Cl. ..... 239/528; 239/530; 239/526; 239/289

[58] Field of Search ..... 239/525-528, 239/289, 290, 296, 300, 390, 397, 414, DIG. 14, 530

[56] References Cited

U.S. PATENT DOCUMENTS

| | | | |
|---|---|---|---|
| 3,524,593 | 8/1970 | Buckley et al. | 239/583 |
| 3,606,170 | 9/1971 | Hoffman et al. | 239/414 |
| 4,225,087 | 9/1980 | Lawlor | 239/526 |
| 5,078,323 | 1/1992 | Frank | 239/528 |

OTHER PUBLICATIONS

DeVilbiss Air Spray Guns, Manual, Automatic, Special Purpose, Form 1-2001-a, Jun., 1978, p. 6.

*Primary Examiner*—Andres Kashnikow

*Assistant Examiner*—Karen B. Merritt

*Attorney, Agent, or Firm*—MacMillan, Sobanski & Todd

[57] ABSTRACT

An ergonomic hand held paint spray gun which reduces operator fatigue and stress. The handle of spray gun has an ergonomically designed shape and the size of the handle may be changed through the use of different size handle covers. The spray gun has a plurality of triggers arranged to be operated by different fingers and to facilitate operation when the gun is held in different orientations to reduce fatigue and operating frequency stress on an operator's fingers. Some of the triggers operate low force valves which supply pilot air to a pilot valve which opens the fluid and air valves. The paint and air hoses may be attached to alternate locations on the gun to reduce hand and wrist fatigue when painting predominantly vertical surfaces or predominantly horizontal surfaces. A junction box may be located in the paint and air hoses to allow connection of lighter weight hoses to the gun. The junction box is located to be held in the operator's free hand and an optional trigger valve may be located on the junction box for supplying pilot air to remotely trigger the fluid and air valves in the gun. For operating an HVLP gun, a pressure regulator may be located in the junction box to drop high pressure air to the high volume low pressure air flow required by the gun.

11 Claims, 6 Drawing Sheets

ERGONOMIC HAND HELD PAINT SPRAY GUN

TECHNICAL FIELD

The invention relates to paint spray guns and more particularly to an improved hand held paint spray gun which includes multiple triggers, multiple paint and air hose mounting locations and an improved shape, all of which reduce operator fatigue and stress.

BACKGROUND ART

Many jobs require the use of hand held paint spray guns. These include certain jobs in manufacturing and jobs in automotive refinishing shops, for example. When an operator is required to frequently use a spray gun over a long period of time, the operator may develop fatigue in the hand and wrist. Fatigue can be aggravated by repeated motions, such as by frequently squeezing the spray gun trigger with the same finger motion, by unbalanced forces on the hand and wrist, by the weight of the gun, and by the force required to operate the gun trigger.

Typically, paint spray guns are manufactured from metals such as aluminum, stainless steel and brass, which resist attack from the materials being sprayed and are durable when used in a commercial environment. Such materials are relatively heavy and consequently result in a relatively high gun weight. The most commonly used spray guns use air for liquid atomization. The atomization air may be either at a relatively high pressure or it may be a high volume low pressure (HVLP) air flow. Where high pressure air is supplied to the gun, a relative strong trigger return spring has been used to assure closure of the liquid and air valves. A typical prior art spray gun may require a force on the order of 6 pounds (2.7 Kg.) to squeeze the trigger.

Normally, at least the compressed air is supplied to the gun through a hose secured to the gun handle. The paint or other coating fluid also may be supplied through a hose secured to the gun handle or it may be supplied through a hose or a paint cup secured to the gun body near a nozzle. The entire weight of the gun, air hose and paint supply hose must be supported by the operator's hand and wrist. There has been no suitable way for transferring some of the weight, for example, directly onto the arm of the operator in place of the wrist. At best, the operator could reduce the torque exerted on the gun by the air and paint hoses by holding the hoses with his or her free hand. Further, while the gun may be somewhat balanced for spraying a vertical surface, it can be awkward and stressful to spray a horizontal surface, such as the top or hood of an automobile. This is due to the design of the prior art guns to be held only by a handle. When spraying a horizontal surface, the wrist and arm must be angled to aim the gun at the horizontal surface.

DISCLOSURE OF INVENTION

The invention is directed to an ergonomic hand held paint spray gun which reduces stress on the hand and wrist of an operator. The spray gun has one or more of several features. Preferably, the gun body and a nozzle assembly are formed from synthetic resinous materials to reduce the weight supported by the operator's hand and wrist. The handle of the gun is shaped to better fit the operators hand, as compared to prior art spray gun handles which typically are straight sided. Different size and shape replaceable covers may be used on the gun to more comfortably fit different size operator hands. The air and coating fluids are supplied through two hoses which have two alternate connection locations. In one connection location, the hoses are secured to a lower end of the gun handle. In a second connection location, the hoses are secured to the rear end of the gun body. This location is particularly desirable where vertical surfaces are being painted since the hoses will initially extend from the gun generally parallel to the operators arm. The hoses can be loosely supported from the operators arm, for example, with a strap having a VELCRO hook and loop type fastener, to transfer a portion of the weight and the torque of the hoses from the hand and wrist to the arm.

The spray gun has an improved triggering arrangement to reduce frequency induced stress and fatigue. A valve needle assembly is arranged to open both an atomization air valve and a coating fluid valve. Multiple triggers are provided for operating the gun with alternate trigger options using different fingers and to facilitate holding the gun with different hand positions, for example, when painting vertical or horizontal surfaces. A first trigger is located generally parallel to the gun handle, as in prior art guns. The trigger is designed to operate with less force than typical prior art guns to reduce finger stress and fatigue. The first trigger may be pivoted away from the handle when not in use to facilitate gripping the gun body, for example, when painting a horizontal surface. When the body is gripped, a second trigger extending from the body may be used. The gun also may include a trigger button on the gun body or a pair of trigger buttons on opposite sides of the gun body adjacent the top of the gun handle. The trigger buttons are located to be actuated by the thumb. When a pair of trigger buttons are provided, they are located to be actuated by either a right handed operator or a left handed operator when the gun is held either by the handle or by the gun body. The trigger buttons cause pilot air to move a piston to trigger the gun. Consequently, very little force is required to operate the trigger buttons.

In order to reduce operator fatigue and stress caused by the weight of the air and coating material supply hoses, the hoses may be connected to a junction box and short lighter weight hoses may connect from the junction box to the gun. The operator can hold the junction box in his or her free hand or suspend the junction box from a shoulder strap. An optional manual valve may be located on the junction box to turn the gun on and off, for example by supplying pilot air to move the piston in the gun to trigger the gun. The junction box valve will transfer some of the hose weight and torque to the operator's free hand, reducing stress on the hand holding the gun. If the spray gun is of the HVLP type which operates with air at no greater than, for example, 10 psig (0.68 bar), a regulator may be located in the junction box for dropping air from a high pressure source to the high volume low pressure needed by the spray gun.

Accordingly, it is an object of the invention to provide an ergonomically designed hand held paint spray gun which reduces operator fatigue and stress.

Other objects and advantages of the invention will be apparent from the following detailed description and the accompanying drawings.

BEST MODE FOR CARRYING OUT THE INVENTION

Figure 1:
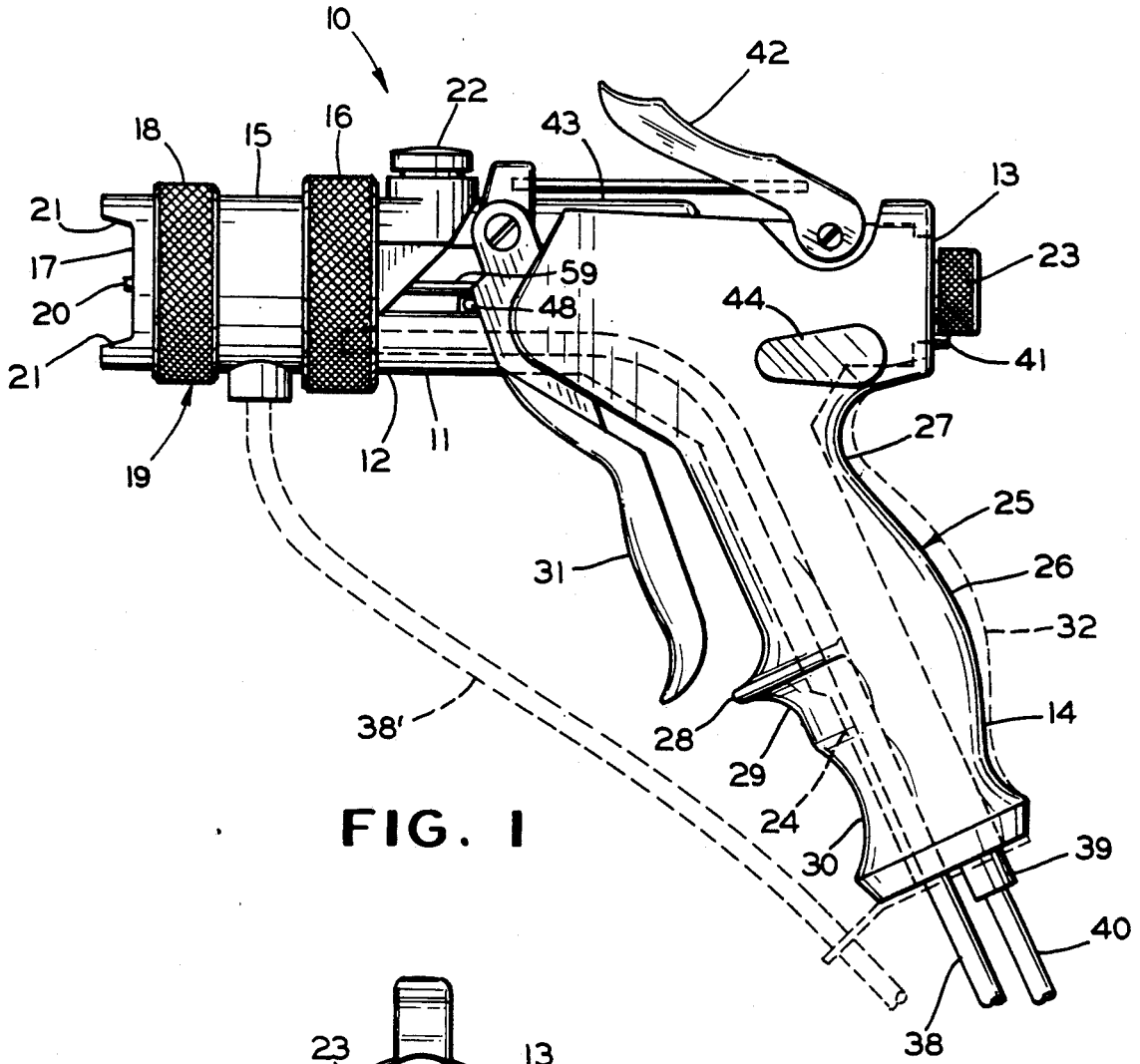
FIG. 1 is a side elevational view of an ergonomic hand held paint spray gun according to the invention with the paint and air hoses secured to the handle.

Referring now to FIG. 1 of the drawings, an ergonomic paint spray gun 10 is shown according to the invention. The spray gun 10 generally includes a gun body 11 having a front end 12 and a rear end 13, a handle 14 depending from adjacent the rear end 13, a fluid tip 15 secured to the front end 12 by a retainer ring 16 and an air cap 17 secured to the fluid tip 15 by a retainer ring 18. The fluid tip 15 and the air cap 17 form a nozzle assembly 19 for discharging and atomizing paint or other coating fluids. The paint is discharged from an orifice 20 and atomized by a surrounding flow of atomization air in a conventional manner. Optionally, pattern shaping air may be directed at opposite sides of the envelope of atomized paint from air horns 21 on the air cap to flatten the atomized paint envelope into a fan shaped pattern in a known manner. A manually adjusted valve 22 is located adjacent the front body end 12 for adjusting the flow of pattern shaping air to select a desired pattern ranging from a round spray pattern to a maximum flat shaped spray pattern. As will be discussed in greater detail below, a knob 23 extends from the rear body end 13 for adjusting the maximum flow of paint or other coating fluid.

The spray gun body 11 is preferably molded from a strong, light weight synthetic resinous material which is resistant to attack by the materials sprayed by the gun 10. A handle frame 24 is integrally molded with the body 11. The handle 14 consists of a replaceable grip 25 which covers the handle frame 24 and a rear portion of the body 11. A center region of the grip 25 has a rear bulge 26 shaped to comfortably fit the palm of the operator's hand. The grip 25 has a reduced diameter portion 27 above the bulge 26 for receiving the portion of the hand between the thumb and the index finger. A projection 28 extending from a front of the grip is located to extend between the lower two fingers which are received by finger recesses 29 and 30 and the upper two fingers which extend over a trigger 31. The contour of the grip 25 provides optimal two finger trigger usage and an optimal two finger and thumb hold on the gun 10.

Preferably, the grip 25 is molded from a polyethylene foam which is resilient, comfortable to hold and protects the gun body 11 in the event that the gun 10 is dropped. The grip 25 is designed to be replaceable. Different size grips 25 may be provided for accommodating different size operator hands. For example, the illustrated grip 25 is made for one size hand and a dashed line 32 represents a larger grip for accommodating a larger hand size. However, it should be appreciated that in the broadest aspects of the invention, the gun handle frame 24 may be provided with the desired ergonomic shape and that the replaceable grip 25 ma be omitted.

Figure 2:
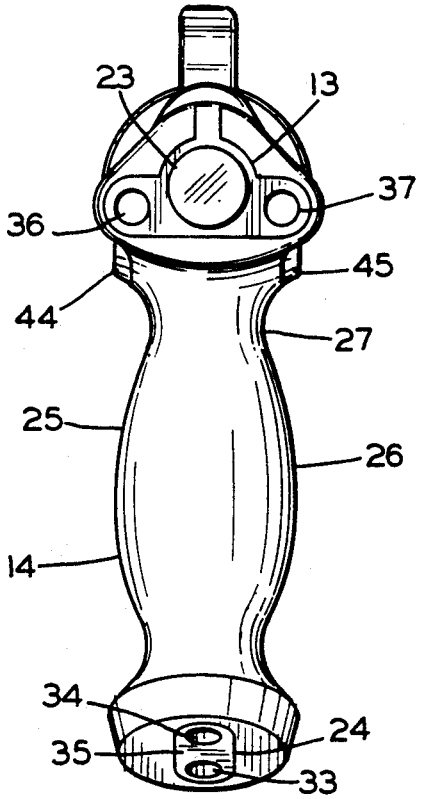
FIG. 2 is a rear elevational view of the spray gun of FIG. 1 with the paint and air hoses removed.

As best seen in FIG. 2, a pair of openings 33 and 34 are formed in a lower end 35 of the handle frame 24. A corresponding pair of openings 36 and 37 are formed in the rear end 13 of the body 11. Either of the openings 33 or 36 is adapted to receive a paint hose 38 (FIG. 1) and either of the openings 34 or 37 is adapted to receive a connector 39 on an air hose 40. The paint hose openings 33 and 36 are connected together and are connect to the fluid tip 15 by passages (not shown) through the handle frame 24 and the gun body 11. In the embodiment illustrated in FIG. 1, the paint hose 38 is inserted through the handle opening 33, passes through the handle frame 24 and the gun body 11 and is connected to the fluid tip 15. The air openings 34 and 37 also are connected together and are connected to the fluid tip 15 by passages (not shown) through the handle frame 24 and the gun body 11. The connector 39 secures the air hose 40 to the opening 34 and a plug 41 (FIG. 1) closes the gun body opening 37 to prevent air pressure loss through the opening 37. As a further option, the paint hose 38 can be supported from the gun handle frame 24 and can be connected directly to the fluid tip 15, as shown by the dashed line hose end 38'.

Figure 3:
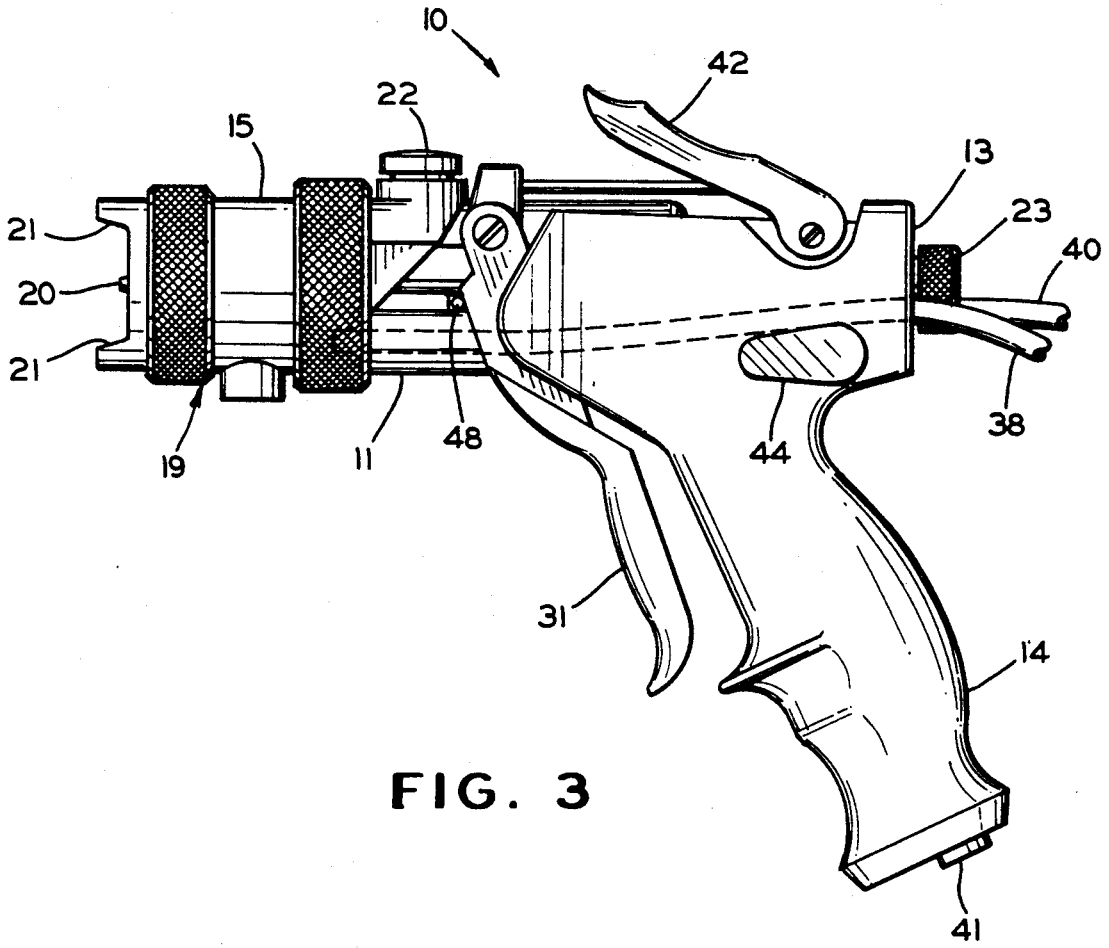
FIG. 3 is a side elevational view of the spray gun of FIG. 1, except that the paint and air hoses are secured to the gun body.

As shown in FIG. 3, the paint hose 38 and the air hose 40 alternately may be connected to the gun body end 13. The paint hose 38 is passed through the opening 36 in the end 13, through the internal passages in the gun body 11, and is secured to the fluid tip 15. The plug 41 is removed from the opening 37 and is secured to plug the handle end opening 34. The air hose connector 39 then is secured to the opening 37 from which the plug 41 was removed. Accordingly, the operator of the spray gun 10 has the option of having the paint and air hoses 38 and 40 attached either to the lower handle end 35 or to the rear gun body end 13.

The spray gun 10 is provided with a plurality of triggers to give the operator alternate arrangements for turning on the gun 10. By using different trigger fingers and different finger motions, frequency stress to the fingers and hand are reduced. The trigger 31 is arranged generally parallel to the handle 14, as with conventional spray gun triggers, and pivots towards the handle 14 when squeezed. A second trigger 42 is secured to pivot from the gun body 11 from adjacent the rear end 13. The trigger 42 normally angles slightly away from a top 43 of the gun body and is pivoted towards the top 43 when squeezed to trigger the gun. A pair of pivotal trigger buttons 44 and 45 are located on opposite sides of the gun body 11 for actuation by the operator's thumb. By providing buttons 44 and 45 on opposite sides of the gun 10, they may be actuated when the gun is held in either the left hand or the right hand. If desired, only a single trigger button 44 or 45 may be provided.

Figure 4:
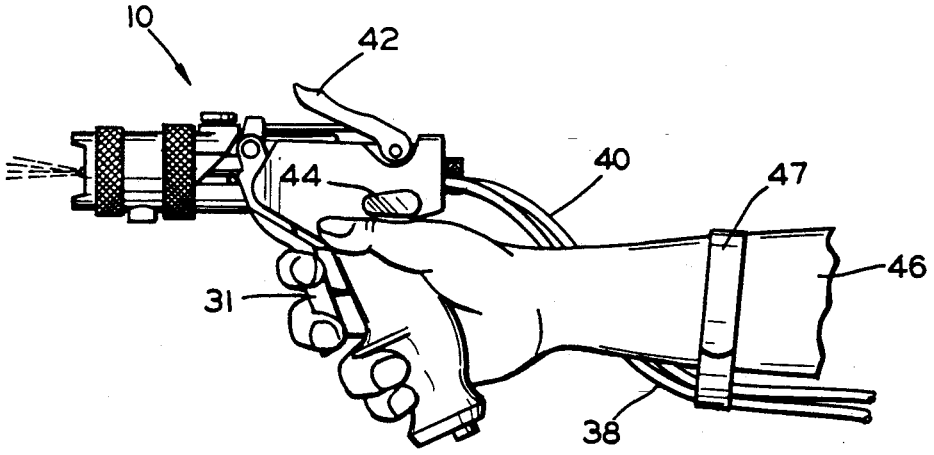
FIG. 4 is a diagrammatic view showing an operator holding the spray gun of FIG. 3 with the hoses strapped to the operator's arm.

In order to reduce the weight and torque exerted on the operator's wrist by the paint and air hoses 38 and 40, the hoses may be supported from the operator's arm during extended use. If the spray gun 10 is being used primarily for painting vertically oriented surfaces, the operator may find it convenient to have the hoses 38 and 40 secured to the rear gun body end 13. As shown in FIG. 4, the hoses will then extend from the gun in a direction generally parallel to the operator's arm 46 before they drop towards the floor. A strap 47 may be used to support the weight of the hoses 38 and 40 from the arm 46. Preferably, the strap 47 is provided with a VELCRO hook and loop type fastener to facilitate attachment and removal from the arm 46.

Figure 5:
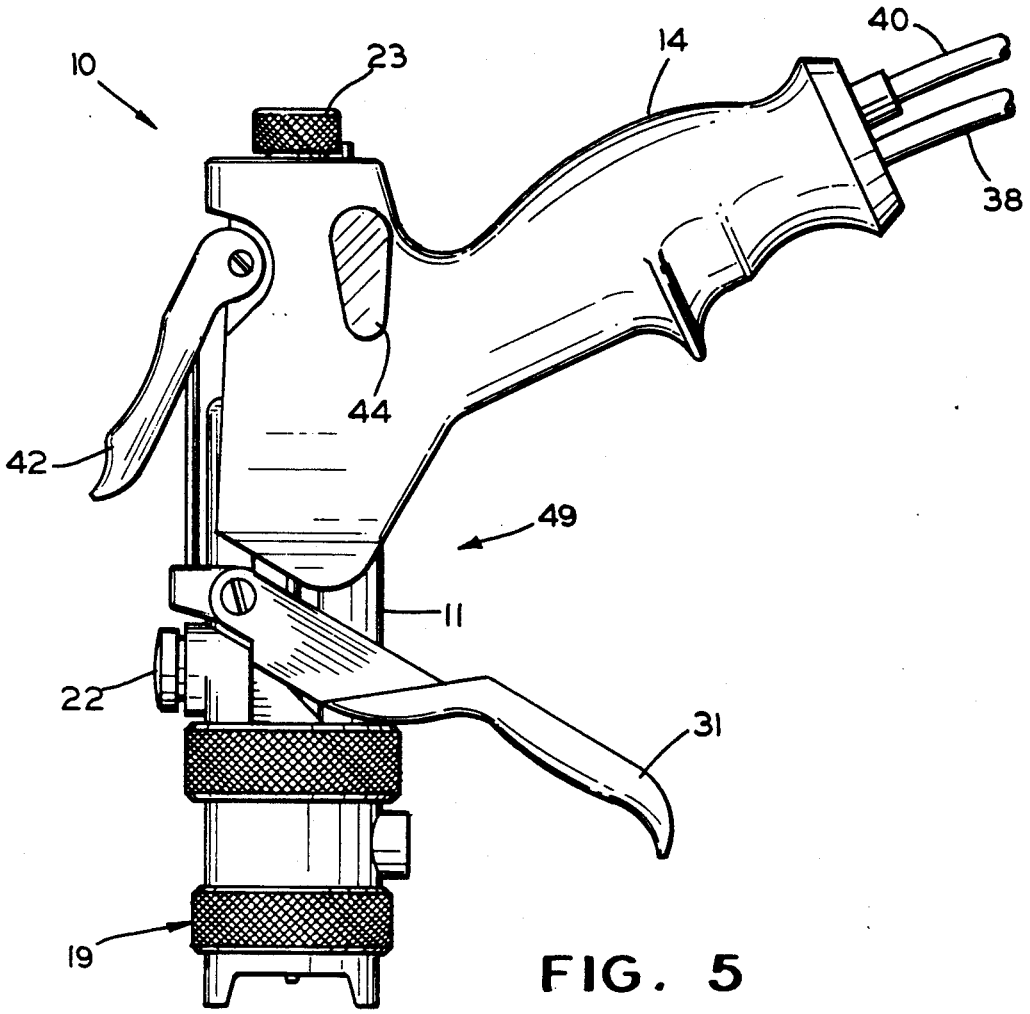
FIG. 5 is a side elevational view of the spray gun of FIG. 1 with the main trigger positioned to facilitate grasping the gun body for spraying a horizontal surface.
Figure 6:
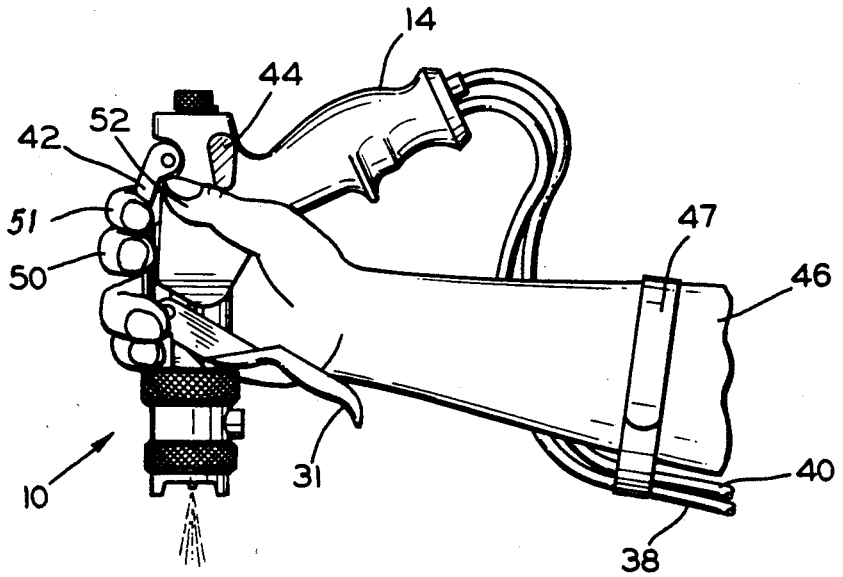
FIG. 6 is a diagrammatic view showing an operator holding the spray gun of FIG. 5 with the hoses strapped to the operator's arm.

As shown in FIG. 1, a stop 48 such as a spring loaded ball is located on the gun body 11 as a stop for the trigger 31. When the trigger 31 is released, a trigger return spring (not shown) located between the trigger 31 and the gun body 11 moves the trigger 31 against the stop 48. The stop 48 normally limits the distance that the trigger 31 will pivot away from the handle 14 when the trigger 31 is released. However, if the trigger is pushed away from the handle 14, the stop 48 retracts to allow the trigger 31 to move further away from the handle 14 to the position shown in FIG. 5. This opens up a relative large area 49 between the handle 14 and the trigger 31 to permit grasping the gun body next to the handle 14. FIG. 6 shows the operator's arm 46 with the hand grasping the gun body 11 to hold the gun 10 in a vertical orientation. This is particularly suitable for reaching over and spraying horizontal surfaces, such as the top or hood of an automobile. By so holding the gun 10, the operator does not have to bend the wrist to hold the gun vertical. To hold the gun handle 14 with the gun 10 in the vertical position of FIG. 6, it will be appreciated that the wrist must be severely bent and that there will be a tendency to tip the gun to relieve wrist stress. Tipping the gun relative to the surface being sprayed can adversely affect the quality of the applied coating. The torque and weight on the wrist from the hoses 38 and 40 can be reduced by securing the hoses to the gun handle so that they initially project generally parallel to the operator's arm 46 and securing the hoses 38 and 40 to the arm with the strap 47. This arrangement also helps to keep the hoses 38 and 40 away from the surface being sprayed.

With the gun 10 held in the vertical position shown in FIG. 6, the trigger 42 is conveniently located for operating the gun 10 with the upper two fingers 50 and 51 on the hand grasping the gun body 11. As an alternative, the operator's thumb 52 may easily operate the trigger button 44, providing relief for the fingers 50 and 51. Or, for a left handed operator, the operator's thumb may be used to operate the trigger button 45.

Figure 7:
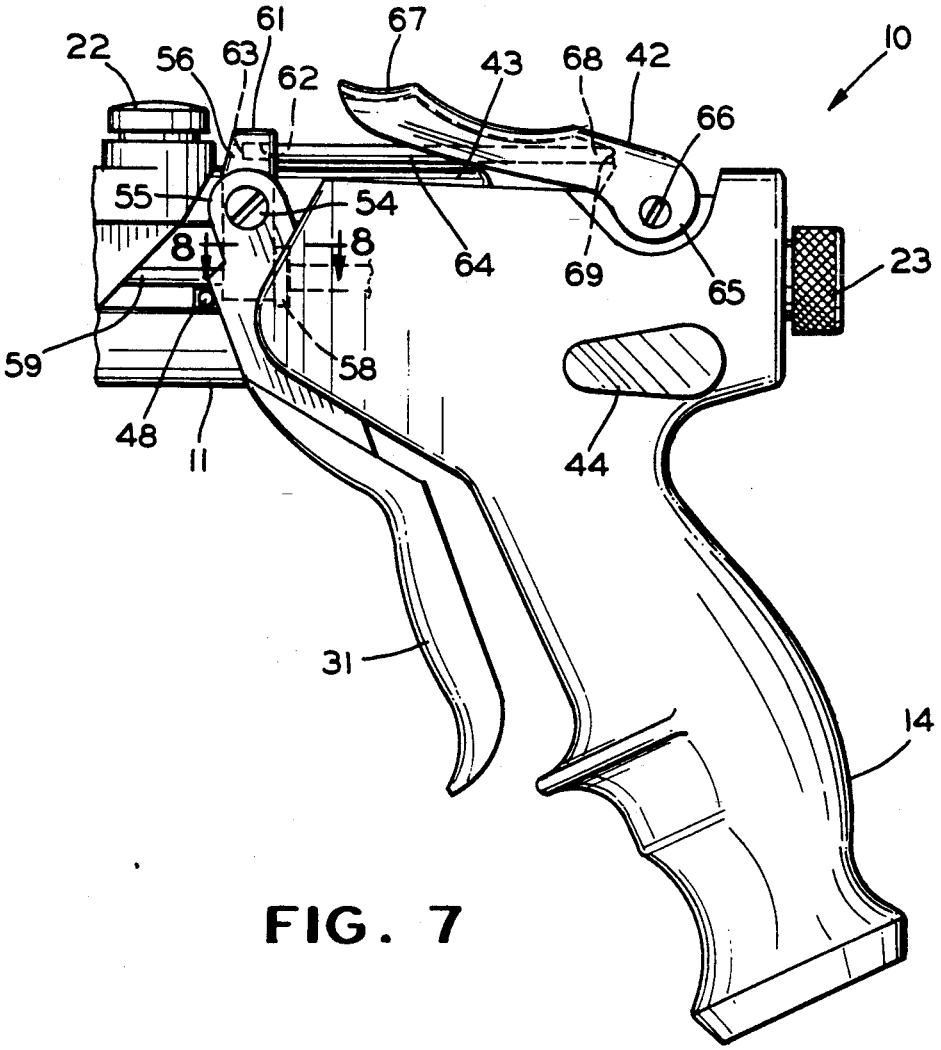
FIG. 7 is an enlarged fragmentary side elevational view of the spray gun showing details of the top trigger.
Figure 8:
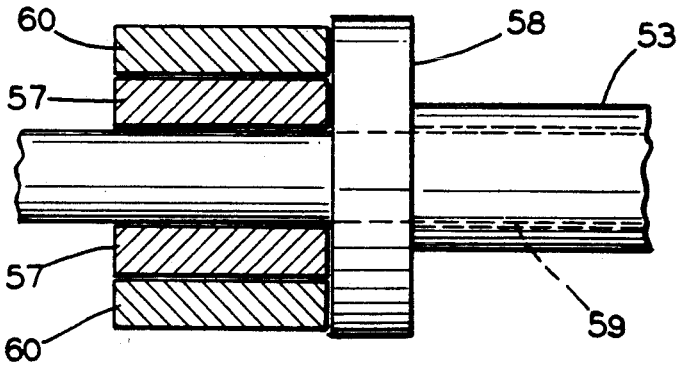
FIG. 8 is a fragmentary cross sectional view taken along line 8—8 of FIG. 7.

FIGS. 7 and 8 show details of the operation of the triggers 31 and 42. A screw 54 pivotally secures an upper end 55 of the trigger 31 and an inverted Y-shaped bracket 56 to the gun body 11. The bracket 56 has two lower sides 57 which engage a flange 58 which is mounted to slide on a valve needle 59. The upper trigger end 55 also has inwardly directed tabs 60 which engage the flange 58. When the trigger 31 is squeezed, the tabs 60 engage and move the flange 58 in an axial direction on the valve needle 59 and push a tube 53 which extends coaxially over the valve needle 59. As is discussed below in reference to FIG. 9, the initial movement of either the trigger 31 or 42 opens an air valve to establish a flow of atomization air and of any pattern shaping air and further movement of the trigger 31 or 42 will open the fluid valve to establish a discharge of coating fluid from the nozzle assembly 19.

The bracket 56 has an upward projection 61 having a recess 62 receiving an end 63 of a rod 64. Or, the rod end 63 may be pivotally secured to the bracket projection 61, for example, by a C-shaped clip (not shown) secured to the rod end 63 for engaging a rounded portion on the bracket projection 61. An end 65 of the trigger 42 is pivotally secured by a screw 66 to the gun body 11 adjacent the end 13. A suitable spring (not shown) is located between the trigger 42 and the gun body 11 to pivot a free end 67 of the trigger 42 away from the gun body top 43. A second end 68 of the rod 64 is seated in a recess 69 in the trigger 42. When the trigger end 67 is squeezed towards the gun body 11, the rod 64 pushes against the bracket end 61 to in turn pivot the bracket 56. This in turn causes the lower bracket sides 57 to move the tube 53 to first open the air valve and then to open the fluid valve to initiate spraying of atomized coating material. Preferably, the trigger recess 69 for the rod end 68 is located directly in line with the screw 66 and the bracket recess 62 for the rod end 63 is located directly in line with the screw 54. This arrangement minimizes friction when the trigger 42 is squeezed.

Figure 9:
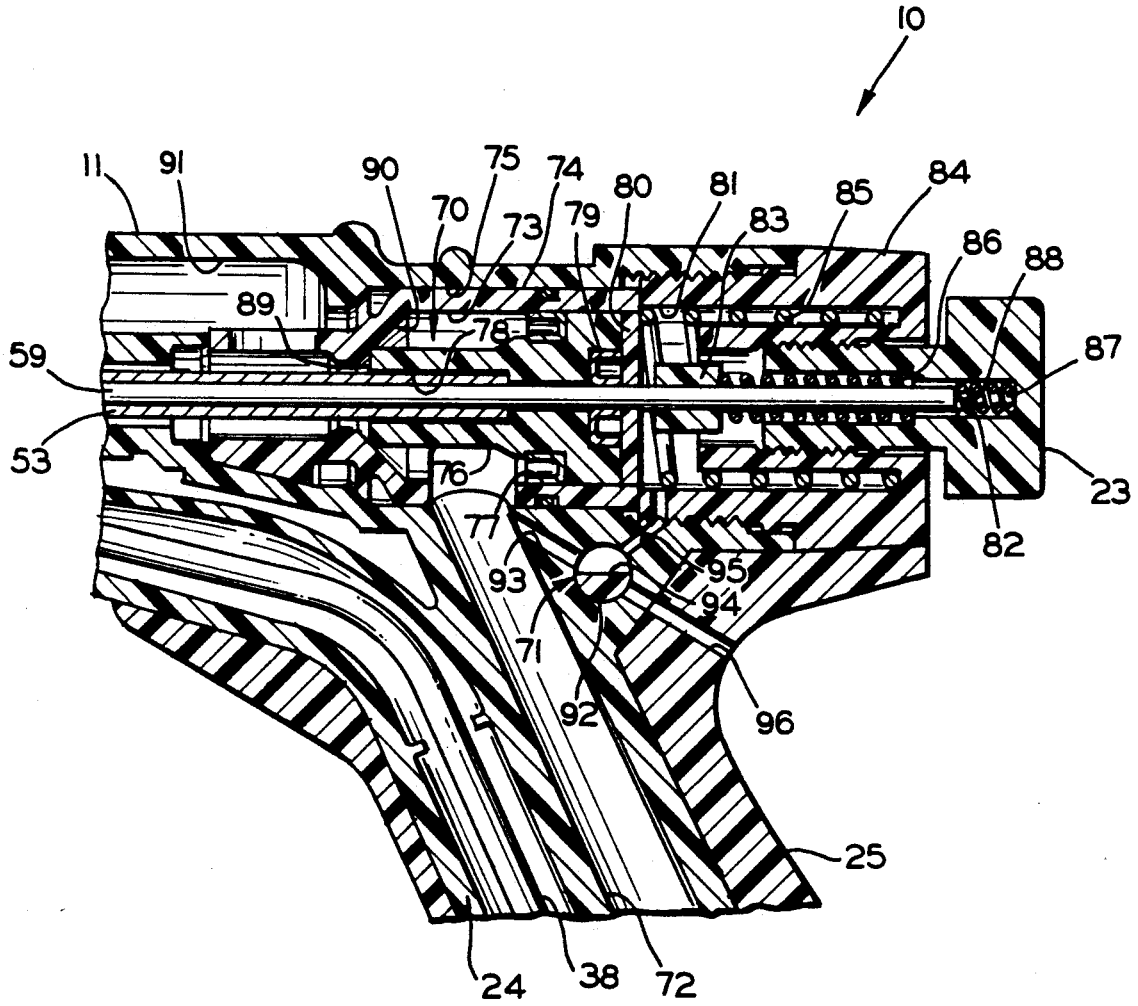
FIG. 9 is an enlarged fragmentary cross sectional view through a rear portion of the spray gun body showing details of the mechanism for triggering the gun.

FIG. 9 is a fragmentary cross sectional view showing details of an atomization and pattern shaping air valve 70 and of a pilot valve 71 which is operated by the trigger buttons 44 and 45. The air hose 40 is connected by the fitting 39 (FIG. 1) to a passage 72 in the handle frame 24. The passage 72 and also a passage (not shown) from the opening 37 (FIG. 2) connect to a chamber 73 located in an insert 74 positioned in a rear opening 75 in the gun body 11. A piston 76 is mounted to slide in the insert 74. An annular seal 77 prevents air leakage between the piston 76 and the insert 74 as the piston 76 slides. The tube 59 extends partially into a stepped opening 78 through the piston 76, while the valve needle 59 passes through the opening 78. A seal 79 allows the valve needle 59 to slide in the piston opening 78 while preventing gas leakage between the valve needle 59 and the piston 76. The valve needle 59 passes through a bearing plate 80, a chamber 81 and into an axial opening 82 in the fluid valve knob 23. A sleeve 83 is secured to the valve needle 59 within the chamber 81. While the triggers are all released and the gun 10 is off, the sleeve 83 is spaced from the bearing plate 80.

The fluid valve knob 23 is threaded into a cap 84 which in turn is threaded into the gun body opening 75. A helical compression spring 85 is partially compressed between the cap 84 and the bearing plate 80 to urge the piston 76 to the left in FIG. 9. A second helical compression spring 86 is partially compressed between the knob 23 and the sleeve 83 on the valve needle 59. A third helical spring 87 is located in the knob opening 82 between the knob 23 and an end 88 of the valve needle 59.

The spring 85 urges the piston 76 to the left in FIG. 9 until an annular edge 89 on the piston 76 seats against a conical surface 90 in the insert chamber 73. The edge 89 and the surface 90 form the air valve 70. So long as the piston 76 is seated against the surface 90 air is prevented from flowing from the gun handle passage 72 to a gun body passage 91. When either of the triggers 31 or 42 is squeezed, the tube 53 is moved to the right to separate the piston edge 89 from the surface 90 to open the air valve 70, allowing air to flow from the passage 72 to the passage 91 and thence to the nozzle assembly 19 (FIG. 1). Because of the initial spacing between the bearing plate 80 and the valve needle sleeve 83, the air valve 70 will open prior to the bearing plate 80 contacting the sleeve 83. Further movement of the piston 76 to the right after this spacing is closed will move the valve needle 59 to the right to open a fluid valve (not shown) in the fluid tip 15. The fluid valve in the fluid tip 15 is of a conventional design. When either of the triggers 31 or 42 is squeezed, the valve needle 59 will normally be moved to the right until the needle end 88 contacts the spring 87. The amount of normal movement in the valve needle 59 is controlled by the amount that the knob 23 is threaded into the cap 84. The spring 87 is, significantly heavier than the springs 85 and 86. When the valve needle end 88 is moved so that the ends of the spring 87 are in contact with the valve needle end 88 and the knob 23, the trigger action will feel as if the trigger has moved to its limit. The spring 87 is a safety feature which prevents damage to the gun 10 in the event that a trigger 31 or 42 is over stressed. If a trigger is squeezed too hard, the spring 87 will compress without causing damage.

The piston 76 also is responsive to the pilot valve 71 for triggering spraying by the trigger buttons 44 and 45. The trigger buttons 44 and 45 are mounted to rotate a shaft 92 which is mounted in the gun body 11. The rear chamber 81 is connected through a passage 93 to receive pressurized air from the handle passage 72 The passage 93 extends through the gun body 11 or through the piston 76. As illustrated, the passage 93 connects from the passage 72 through a notch 94 in the shaft 92 and a passage 95 to the chamber 81. The passage 93 normally maintains the chamber 81 at substantially the same pressure as the chamber 73 to allow the piston 76 to slide in the insert 74. However, rotation of either trigger button 44 or 45 will cause the notch 94 to block the passage 93 and to connect the passage 95 to a passage 96 which is vented to atmosphere. This vents the chamber 81 to cause a pressure differential across the piston 76. The pressure differential is sufficient to move the piston 76 against the force of the spring 85 and open the air valve 70 and the fluid valve. The trigger buttons 44 and 45 easily rotate to vent the chamber 82 without the need to manually overcome the force of the spring 85. It should be appreciated that the passage 93 may connect directly to the chamber 81 rather than through the valve 71. In this case, the passage 93 is of a restricted diameter and the passages 95 and 96 are of a significantly larger diameter in order to drop the pressure in the chamber 81 when the trigger buttons 44 or 45 are operated. It also should be appreciated that although the trigger buttons 44 and 45 are shown and described as being rotatable for rotating the shaft 92, that they can be replaced with button valves which are actuated by pushing on either buttons 44 or 45.

Figure 10:
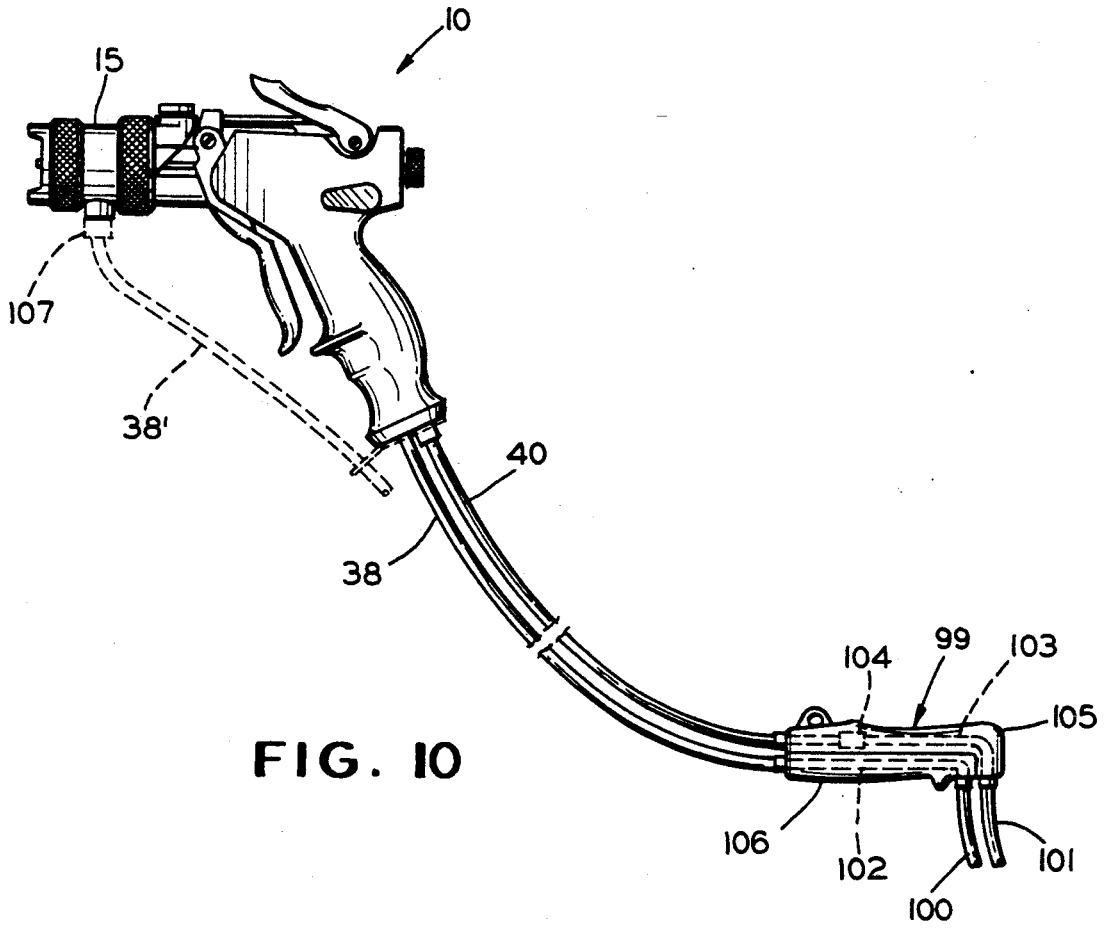
FIG. 10 is diagrammatic view showing a junction box located in the air and coating fluid supply line.

As shown in FIG. 10, the fluid hose 38 may be of a lighter than standard weight and an optional junction box 99 can be located between the fluid hose 38 and a heavier standard weight fluid hose 100. The junction box 99 also can connect a lighter than standard air hose 40 with a heavier standard weight air hose 101. The standard weight hoses 100 and 101 must be capable of withstanding abrasion when dragged across the floor, when walked on, etc. The junction box 99 is designed to be held in the operator's free hand. The illustrated lighter hoses 38 and 40 may be any convenient length, for example, about 1 meter long. The junction box 99 may simply have a passage 102 which connects the fluid hose 100 to the fluid hose 38 and an air passage 103 which connects the air hose 101 to the air hose 40. If the spray gun 10 is of the HVLP type, the air hose 101 may supply a relatively low volume flow of high pressure air to a pressure regulator 104 in the air passage 103. The regulator 100 reduces the air flow to the high volume low pressure flow required by the gun. For example, the regulator 104 may drop a line air pressure of between 50 psig and 125 psig (3.4 bars to 8.5 bars) to, for example, a pressure of no greater than 10 psig (0.68 bar). This eliminates the need to locate special calibrated orifices or valves or regulators in the spray gun 10 to control the air pressure, which can increase the weight of the gun 10.

In certain commercial painting operations, it is necessary to have the capability of rapidly changing paint colors, for example, when painting successive workpieces different colors. In some paint spray booths, a separate paint hose is provided for each color paint and each hose is terminated with a quick connect fitting for attaching to the spray gun. For use with such an arrangement, the junction box 99 may be formed with a section 105 for connecting the air hoses 40 and 101 and a separate section 106 for connecting the paint hoses 38 and 100. Each color paint hose has a section 106 attached. After a particular color paint hose is selected, the section 106 on the selected hose is snapped onto the air hose section 105 and the hose 38 is attached to the gun 10. Preferably, the hose has an end 38' which is connected directly to the gun fluid tip 15 by a quick connect fitting 107. This allows for a rapid color change and minimizes the amount of paint which must be cleared from the gun 10 since the is old paint is present only in the fluid tip 15.

Figure 11:
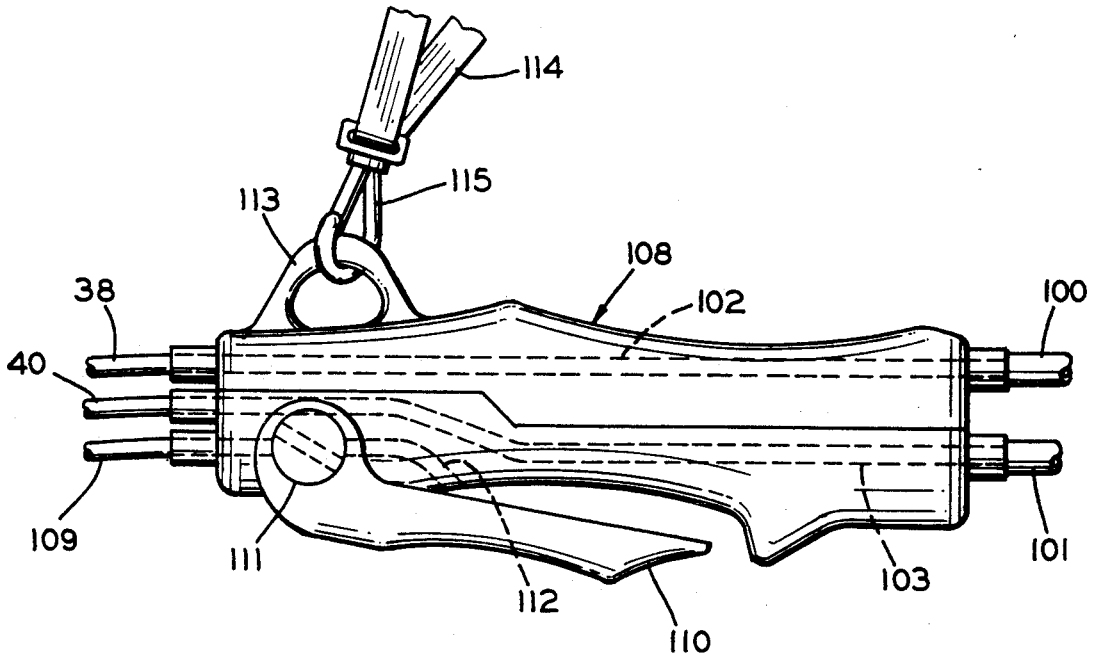
FIG. 11 is an enlarged side elevational view showing a junction box with a remote trigger valve.

FIG. 11 shows a modified junction box 108 located between the fluid hoses 100 and 38 and the air hoses 101 and 40. The passage 102 connects the fluid hoses 100 and 38 and the passage 103 connects the air hoses 101 and 40. An additional pilot air hose 109 leads from the junction box 108 to the spray gun 10. The pilot air hose 109 connects to the rear chamber 81 behind the piston 76 (FIG. 9). A trigger 110 is pivotally mounted on the junction box 105. When the trigger 110 is squeezed, a valve member 111 rotates to vent the pilot air hose 109 through a passage 112 to atmosphere. This in turn vents the rear chamber 81 in the spray gun 10 (FIG. 9) and the piston 76 moves to trigger the spray gun 10.

The junction box 108 is shown with an integral top loop 113 to which an optional strap 114 may be secured by a hook 115. The strap 114 may extend over the operator's shoulder to support the weight of the junction box 108 and the attached hoses 38, 40, 100, 101 and 109. Thus, it will be seen that the junction boxes 99 and 108 may serve one or more purposes, namely, to transfer some of the weight and torque of the supply hoses from the gun hand to the operator's free hand or shoulder, to allow the connection of lighter weight hoses to the spray gun 10, to mount a pressure regulator, and/or to house a remote trigger for controlling the spray gun 10.

In the above described preferred embodiments of the spray gun 10, the second or top trigger 42 is shown for moving the tube 53 to turn on the gun in the same manner as the trigger 31. It will be appreciated that the trigger 42 may be connected to vent the rear chamber 81 to pneumatically move the piston 76 for triggering the gun 10. Further, the trigger 42 may be replaced with a button type actuator which vents the rear chamber 81 to move the piston 76 for triggering the gun 10. It will be appreciated that various other modifications and changes may be made to the above described preferred embodiments of the spray gun 10 without departing from the spirit and the scope of the following claims.

We claim:

1. An air atomization liquid spray gun including a gun body having first and second ends, a liquid atomization nozzle assembly secured to said first end, a handle extending from adjacent said second end, said handle having a free end, a first passage in said body connecting between said nozzle assembly, a first opening at said second end and a first opening at said free handle end, means for selectively securing an air hose to the first opening in one of said second end and said handle end, means for plugging the first opening in the other of said second end and said handle end, second passage in said gun body connecting between said nozzle assembly, a second opening at said second end and a second opening at said free handle end, and means for selectively securing a liquid supply hose to extend through the second opening in one of said second end and said handle end and through said second passage to said nozzle assembly.

2. An air atomization liquid spray gun, as set forth in claim 1, and further including means for further selectively securing said liquid supply hose directly to said nozzle assembly, and means for supporting said liquid supply hose from said free handle end when said liquid supply hose is secured directly to said nozzle assembly.

3. A liquid spray gun including a gun body having first and second ends, a liquid atomization nozzle assembly secured to said first end, a handle extending from adjacent said second end for grasping by an operator's hand, first trigger means for operation by the operator's fingers when said spray gun is grasped by said handle to turn on said spray gun, and second trigger means for operation by the operator's fingers when said gun body is grasped by the operator to turn on said spray gun.

4. A liquid spray gun, as set forth in claim 3, wherein said first trigger means is pivotally attached to said gun body to normally extend adjacent to and to pivot towards said handle, and means for releasing said first trigger means to pivot away from said handle to facilitate grasping the gun body between said first trigger means and said handle.

5. A liquid spray gun, as set forth in claim 4, and further including at least one third trigger means attached to said gun body to be moved by an operator's thumb from a first position to a second position, means for triggering said spray gun in response to movement of said at least one third trigger means from said first position to said second position.

6. A liquid spray gun, as set forth in claim 5, wherein said at lest one third trigger means comprises two third trigger means with separate third trigger means located on opposite sides of said gun body.

7. A liquid spray gun, as set forth in claim 3, wherein said second trigger means is pivotally attached to said gun body to extend along a portion of said gun body opposite said handle.

8. An air atomization liquid spray gun including a gun body having first and second ends, a liquid atomization nozzle assembly secured to said first body end, a handle extending from adjacent said second body end for grasping by an operator's hand, said handle having a free end, means for selectively securing an air hose to one of said second body end and said handle end, first trigger means for operation by the operator's fingers to turn on said spray gun when said spray gun is grasped by said handle, and second trigger means for operation by the operator's fingers to turn on said spray gun when said gun body is grasped by the operator.

9. An air atomization liquid spray gun, as set forth in claim 8, and further including air passage means in said body connecting between said nozzle assembly, an opening at said second body end and an opening at said free handle end, and wherein said means for selectively securing said air hose includes means for selectively securing said air hose to the opening in one of said second body end and said handle end, and means for plugging the opening in the other of said second body end and said handle end.

10. An air atomization liquid spray gun, as set forth in claim 8, and further including means for selectively securing a liquid supply hose to one of said second body end and said handle end.

11. An air atomization liquid spray gun, as set forth in claim 10, and further including means for further selectively securing said liquid supply hose directly to said nozzle assembly, and means for supporting said liquid supply hose from said free handle end when said liquid supply hose is secured directly to said nozzle assembly.

* * * * *